United States Patent [19]

Stone

[11] 4,377,913

[45] Mar. 29, 1983

[54] DOUBLE TONGUE, DOUBLE LOCKING VAMP ASSEMBLY

[76] Inventor: Fredrick Stone, 7341 Muerdale, West Bloomfield, Mich. 48033

[21] Appl. No.: 226,644

[22] Filed: Jan. 21, 1981

[51] Int. Cl.[3] ..... A43B 13/14; A43B 11/00; A43B 23/26

[52] U.S. Cl. ..... 36/99; 36/50; 36/54

[58] Field of Search ..... 36/50, 51, 54, 99

[56] References Cited

U.S. PATENT DOCUMENTS

| | | | |
|---|---|---|---|
| 830,753 | 9/1906 | Voss | 36/51 |
| 1,247,435 | 11/1917 | McHannan | 36/51 |
| 1,745,654 | 2/1930 | Williams | 36/50 |
| 1,933,467 | 10/1933 | Yartyan | 36/50 |
| 2,603,889 | 7/1952 | Lahnstein et al. . | |
| 3,106,790 | 10/1963 | Zimmon . | |
| 3,205,544 | 9/1965 | Streule et al. . | |
| 3,618,235 | 11/1971 | Cary | 36/54 X |
| 3,626,610 | 12/1971 | Dassler . | |
| 3,845,769 | 11/1974 | Shaw . | |
| 4,114,297 | 9/1978 | Famolare . | |
| 4,126,951 | 11/1978 | Antonious | 36/54 |

*Primary Examiner*—Richard J. Scanlan, Jr.
*Attorney, Agent, or Firm*—Barnes, Kisselle, Raisch, Choate, Whittemore & Hulbert

[57] ABSTRACT

An upper assembly for a shoe, particularly an athletic shoe, comprising a vamp including a throat defined by laterally opposed throat edges, and inner and outer tongues respectively affixed to the vamp adjacent the forward tongue ends and extending rearwardly respectively interiorly and exteriorly of the throat edges. Complementary hook-and-loop fastening elements are mounted on the opposing surfaces of the tongues and throat edges for releasably and adjustably securing the shoe on a foot. Most preferably, the inner tongue is fastened as by stitching or adhesion to the throat side edge adjacent the shoe arch.

5 Claims, 8 Drawing Figures

DOUBLE TONGUE, DOUBLE LOCKING VAMP ASSEMBLY

The present invention relates to shoes, and more particularly to a shoe upper assembly which includes hook-and-loop fastening means to facilitate donning and removal of the shoe.

An object of the present invention is to provide an upper assembly for a shoe which is particularly well suited for persons, such as the aged or very young, who encounter difficulty in securing the usual laces, buckles or straps of conventional shoes. In particular, an object of the present invention is to provide an upper assembly for a shoe wherein the conventional laces, buckles or straps are replaced by pressure contact hook-and-loop type fastening means, such as that marketed under the trademark VELCRO. Another and more specific object of the invention is to provide an upper assembly of the described type which is sufficiently rugged for use in an athletic shoe or the like, but which may also be styled for use in a dress shoe.

The invention, together with additional objects, features and advantages thereof, will be best understood from the following description, the appended claims and the accompanying drawings in which:

Figure 1:
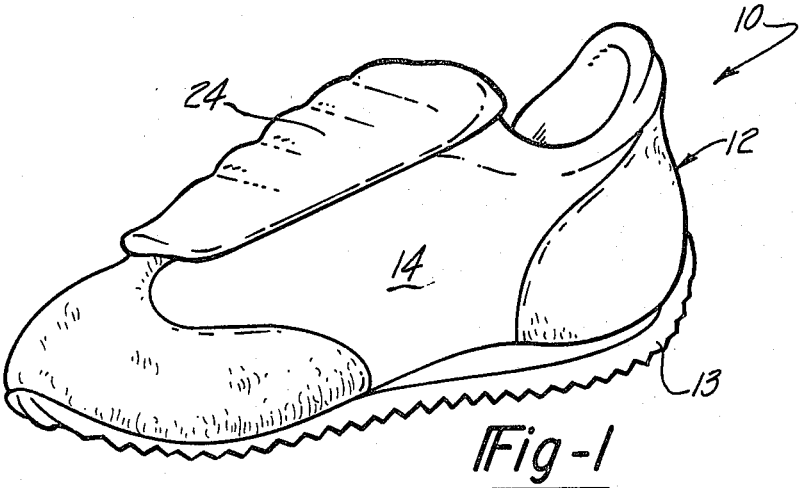
FIG. 1 is a perspective view of an athletic shoe having an upper assembly in accordance with the present invention.

FIGS. 1–4 illustrate an athletic shoe 10 in accordance with a preferred embodiment of the invention as comprising an upper assembly 12 affixed to a rippled sole 13 for use on artificial turf or the like. Upper assembly 12 includes a vamp 14 having a U-shaped throat 16 defined on laterally opposed sides by throat side edges 18,20. An inner tongue 22 is affixed at a forward edge (not shown) by stitching or adhesion to vamp 14 forwardly of throat 16, and extends rearwardly internally of vamp side edges 18,20 beneath throat 16. Preferably, tongue 22 is affixed by stitching or adhesion along one side edge to the opposing vamp edge. For durability in rugged use as in a football shoe or the like, tongue 22 is most preferably affixed to the vamp side edge adjacent the arched portion of the upper assembly, i.e. to the "inside" vamp side edge. Thus, tongue 22 is shown affixed to left-hand vamp edge 18 in FIG. 4 in a right shoe, and would be affixed to right-hand vamp edge 20 in a left shoe (not shown). An outer tongue 24 is affixed by stitching or adhesion at a forward end to the outer surface of vamp 14 forwardly of throat 16, and extends rearwardly externally of vamp 14 and edges 18,20 for covering throat 16.

Figure 3:
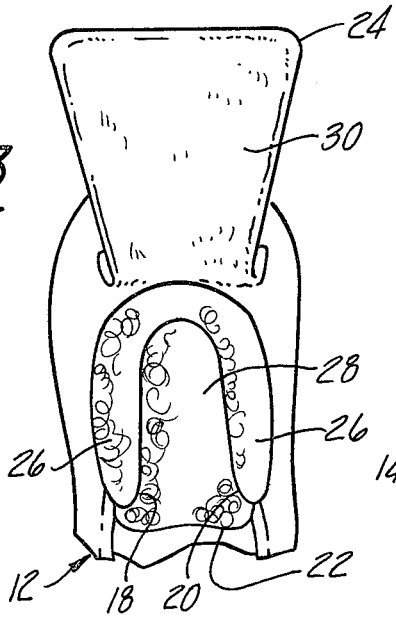
FIG. 3 is a top plan view of the shoe as shown in FIG. 2.

In accordance with an important feature of the present invention, the opposing surfaces of tongues 22,24 and vamp edges 18,20 include complementary hook-and-loop fastening means in the form of sheets or pads. Fasteners of this type are marketed under the trademark VELCRO. More specifically, a U-shaped pad 26 of loop fastener elements is affixed to vamp 14 so as to have a base disposed interiorly adjacent the forward end of outer tongue 24, as best seen in FIG. 3, and laterally opposed arms extending rearwardly along the exterior surfaces of vamp edges 18,20. A strip 28 of loop fastener elements is affixed to the exterior surface of inner tongue 22 and extends laterally from vamp edge 18 to the opposing free edge of tongue 22 beneath vamp edge 20. A pad 30 of hook-type fastening elements is affixed to cover the entire interior surface of outer tongue 24, and a strip 32 of hook-type fasteners is affixed longitudinally to the interior surface of vamp edge 20 opposing inner tongue 22.

Figure 2:
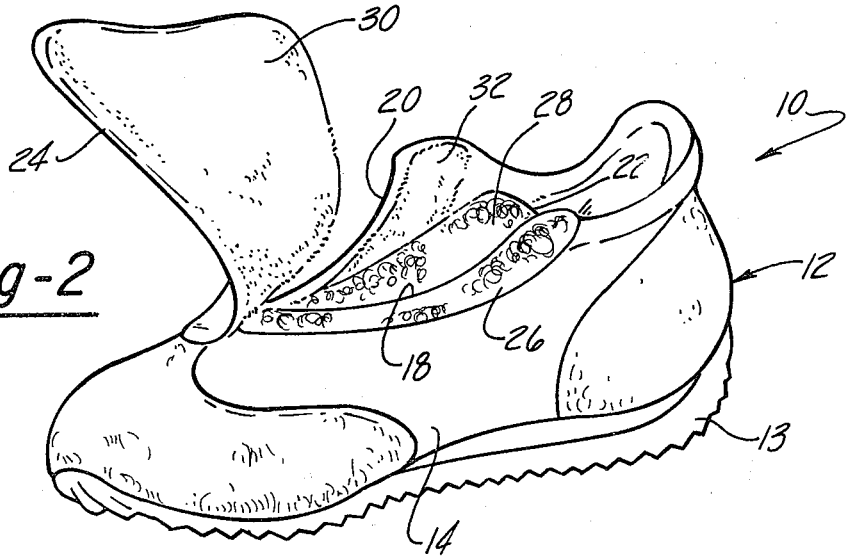
FIG. 2 is a view similar to that of FIG. 1 with the shoe fastening means in the unfastened position.

Thus, with the fasteners and elements of the shoe upper assembly 12 separated as shown in FIG. 2, the shoe 10 may be slipped on the appropriate (right or left) foot. Vamp edge 20 is then adjusted laterally with respect to inner tongue 22 and opposing edge 18 for a comfortable fit widthwise of the shoe over the instep, and then pressed against inner tongue 22 so that the strip 32 is releasably secured to pad 28. Outer tongue 30 is then located over and pressed against side edges 18,20 so that pad 30 is releasably secured to U-shaped pad 26 and the donning of the shoe is completed. The shoe may be readily removed and/or readjusted by reversing the above process.

It will be apparent that the shoe illustrated in FIGS. 1–4 may be donned, adjusted and secured to the foot rapidly and by persons unable or unwilling to manipulate the laces and buckles, etc. of conventional shoes. Additionally, and although the invention may be readily applied to dress or casual type shoes, the embodiment thus far described is particularly well suited for athletic or other rugged uses. As previously indicated, fixed securement of inner tongue 22 to inside vamp edge 18 accommodates substantial stress during rugged athletic use which occurs adjacent the arched portion of upper assembly 12.

Figure 4:
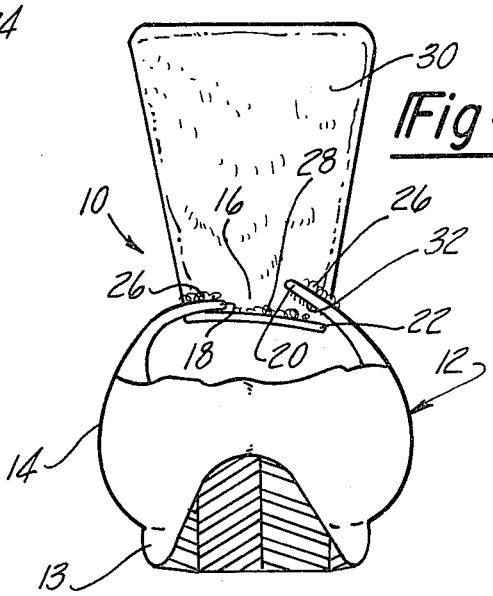
FIG. 4 is a rear elevational partially fragmented view of the shoe as shown in FIGS. 2 and 3.
Figure 5:
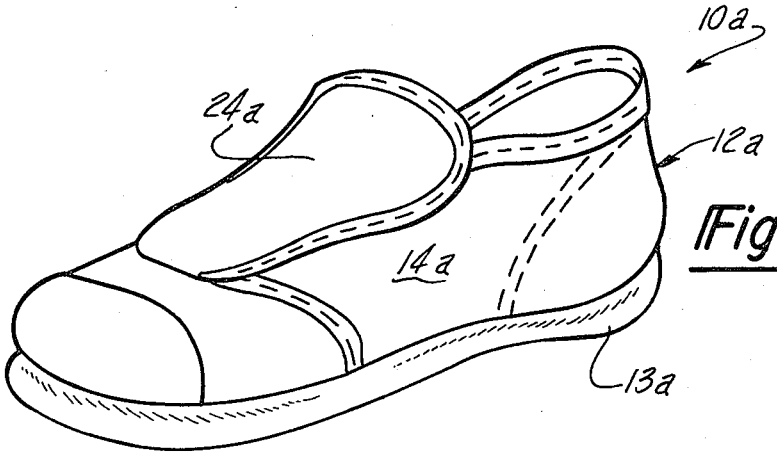
FIG. 5 is a perspective view of a tennis-type athletic shoe embodying an alternative embodiment of the upper assembly in accordance with the invention.
Figure 6:
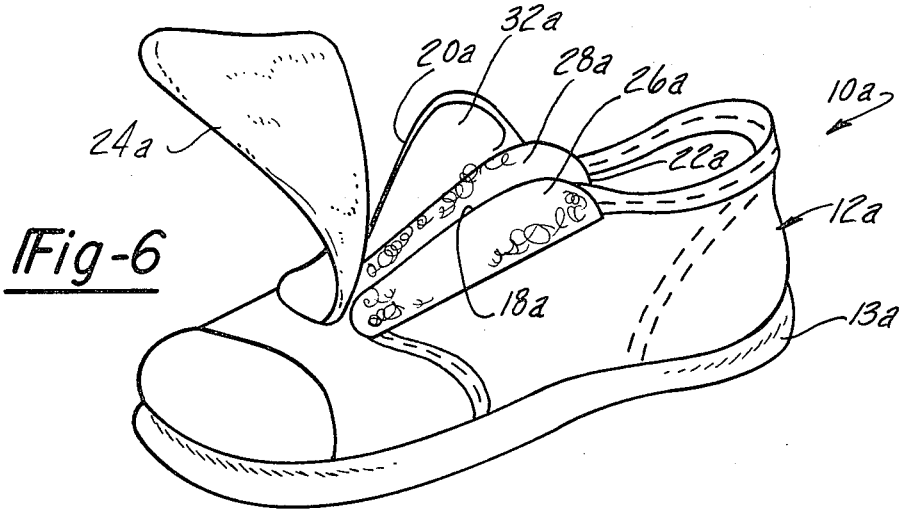
FIGS. 6 and 7 are perspective and rear elevational views of the embodiment of FIG. 5 and are respectively similar to FIGS. 2 and 4.
Figure 7:
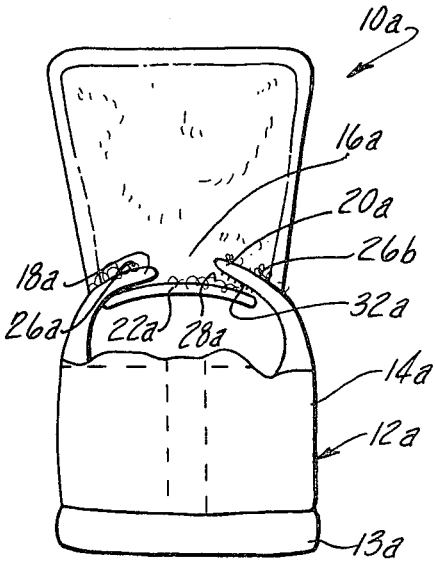

FIGS. 5–7 illustrate a modified embodiment of the invention as applied to a tennis-type athletic shoe having a blucher-type vamp **12*a*, i.e. one wherein the vamp edges 18*a*,22*a* defining the throat 16*a* are separated at the forward throat end. As applied to vamps of this type, the U-shaped pad 26 of loop fastener elements illustrated in FIGS. 2–4 is replaced by opposed strips 26*a*,26*b* respectively disposed on the outside surfaces of vamp edges 18*a*,20*a*. The embodiment of FIGS. 5–7 is otherwise similar to that of FIGS. 1–4**, with like elements being indicated by corresponding reference numerals followed by the suffix "a".

Figure 8:
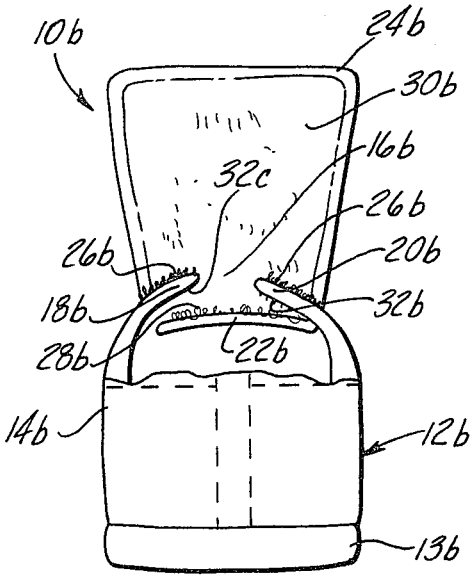
FIG. 8 is a rear elevational view similar to FIG. 7 illustrating a modified embodiment of the invention.

FIG. 8 illustrates a modified upper assembly **12*b* in accordance with the invention wherein the inner tongue 22*b* is separated from both vamp edges 18*b*,20*b* and is covered along its outer surface by a loop-type fastener pad 28*b*. Corresponding hook-type fastener strips 32*b*,32*c* are disposed on the interior surfaces of vamp edges 18*b*,20*b* opposing inner tongue 22*b*, such that both of the vamp side edges may be adjustably positioned with respect to, and then releasably secured to, inner tongue 22*b* prior to securement of outer tongue 24*b* over throat 16*b***.

The invention claimed is:

1. An upper assembly for an athletic shoe comprising a vamp including a throat defined by laterally opposed throat edges, an inner tongue affixed at one end to said vamp and extending rearwardly internally of said vamp and said throat edges, an outer tongue affixed at one end to said vamp and extending rearwardly externally of said vamp and said throat edges for covering said throat, first hook-and-loop fastening means having one portion extending laterally across the outer surface of said inner tongue and a second portion disposed on the outer surface of said vamp along both of said throat edges, and second hook-and-loop fastening means complementary to said first means and having one portion disposed on the inner surface of said vamp along said throat and a second portion across the inner surface of said outer tongue, said throat edges being adapted through said one portion of said first means and said first portion of said second means to be releasably and adjustably secured to said inner tongue with a portion of said one portion of first means on the outer surface of said inner tongue lying in said throat between said throat edges, and said outer tongue being adapted through said second portion of said first means and said second portion of said second means for releasable and adjustable securement to said outer surface of said vamp and to said portion of said first means on said inner tongue lying within said throat.

2. The upper assembly set forth in claim 1 wherein said inner tongue is permanently affixed to one of said throat edges.

3. The upper assembly set forth in claim 2 further comprising means for distinguishing between left and right upper assemblies, and wherein said one of said throat edges comprises the inner throat edge.

4. The upper assembly set forth in claim 1 wherein said first hook-and-loop fastening means on said outer surface of said vamp comprises a unitary length of fastening means extending along one edge of said throat, around a forward edge of said throat, and then along the opposing edge of said throat.

5. An athletic shoe comprising a sole having side edges defining an instep arch, and an upper assembly affixed to said sole and comprising a vamp including a throat defined by laterally opposed throat edges, an inner tongue fixedly secured at a forward end to said upper and extending rearwardly internally of said throat edges, one side of said inner tongue being fixedly and permanently secured to the one of said throat edges adjacent to said arch, an outer tongue affixed at a forward end to said upper and extending rearwardly externally of said vamp and said throat edges for covering said throat, first hook-and-loop fastening means comprising separate sections extending laterally across the outer surface of said inner tongue and disposed on the outer surface of said vamp along both said throat edges, and second hook-and-loop fastening means complementary to said first means and comprising separate sections disposed on the inner surface of said vamp along said throat and across the inner surface of said outer tongue, said throat edges being adapted to be releasably and adjustably secured to said inner tongue with a portion of said first means on the outer surface of said inner tongue lying in said throat between said throat edges, and said outer tongue being adapted for releasable and adjustable securement to said first means on said outer surface of said vamp and to said portion of said first means on said inner tongue lying within said throat.

* * * * *